United States Patent [19]

MacEwen

[11] 4,432,473

[45] Feb. 21, 1984

[54] CARTRIDGE-TYPE DISPENSER

[75] Inventor: George E. MacEwen, Kansas City, Mo.

[73] Assignee: Sealright Co., Inc., Kansas City, Mo.

[21] Appl. No.: 237,808

[22] Filed: Feb. 21, 1984

[51] Int. Cl.[3] ..... B65D 85/72

[52] U.S. Cl. ..... 222/327; 222/386.5; 222/387; 222/490

[58] Field of Search ..... 222/326–327, 222/386, 386.5, 389, 490, 494, 387

[56] References Cited

U.S. PATENT DOCUMENTS

| | | | |
|---|---|---|---|
| 1,484,331 | 2/1924 | Hopkins | 222/326 X |
| 2,090,111 | 8/1937 | Creveling | 221/47.4 |
| 2,106,577 | 1/1938 | Sherbondy | 221/78 |
| 2,193,517 | 3/1940 | Lindstrom | 221/60 |
| 2,456,687 | 12/1948 | Dominguez | 132/13.1 |
| 2,661,126 | 12/1953 | Spencer | 222/386 |
| 2,853,209 | 1/1958 | McArdle | 222/107 |
| 2,855,130 | 10/1958 | Hosler | 222/327 X |
| 2,902,190 | 9/1959 | Hosler | 222/386.5 |
| 3,029,987 | 4/1962 | Gronemeyer | 222/541 |
| 3,273,760 | 9/1966 | Frankenberg et al. | 222/386 |
| 3,274,747 | 9/1966 | Fueslein et al. | 53/22 |
| 3,346,170 | 10/1967 | Carter | 229/43 |
| 3,369,726 | 2/1968 | Wilcox | 229/5.5 |
| 3,407,974 | 10/1968 | Chmielowiec | 222/386.5 |
| 3,682,356 | 8/1972 | Karle | 222/132 |
| 3,884,396 | 5/1975 | Gordon et al. | 222/327 |
| 4,022,355 | 5/1977 | Sabaka | 222/327 |
| 4,027,810 | 6/1977 | Van Manen | 222/327 |
| 4,109,833 | 8/1978 | Gross | 222/389 X |
| 4,117,971 | 10/1978 | Itoh | 229/1.5 B |
| 4,217,995 | 8/1980 | Robillard | 222/327 |
| 4,269,330 | 5/1981 | Johnson | 222/386 |
| 4,356,935 | 11/1982 | Kamin | 222/327 X |

FOREIGN PATENT DOCUMENTS

| | | | |
|---|---|---|---|
| 66826 | 2/1927 | Australia . | |
| 2917464 | 11/1979 | Fed. Rep. of Germany | 222/386 |
| 2951005 | 10/1980 | Fed. Rep. of Germany . | |
| 1329108 | 9/1970 | Netherlands . | |
| 1435053 | 5/1976 | United Kingdom | 222/389 |
| 2026098 | 11/1982 | United Kingdom . | |

*Primary Examiner*—Charles A. Marmor

*Attorney, Agent, or Firm*—Kokjer, Kircher, Bradley, Wharton, Bowman & Johnson

[57] ABSTRACT

A disposable container comprising a filled, temporarily sealed cartridge for use in a caulking gun-like dispenser mechanism for repeated discharge of incremental amounts of the contents thereof of mayonnaise-like consistency. The cartridge includes a generally cylindrical tubular body having an inwardly rolled rim at one end thereof with a generally circular disc sealed within the body in abutment with the rim. A plurality of mutually intersecting slits through the disc form a resilient, pressure-responsive valve and orifice in the center portion of the disc. A plug top closure is disposed within the opposite end of the tubular body and is provided with a tapered side wall sized to be closely received within the tubular body, at least one circumferential rib on the sidewall for tightly, slidingly engaging the tubular body, and a radially outwardly extending closure lip for yieldably engaging the inner surface of the tubular body and providing a liquid tight seal between the top plug closure and the tubular body. An optional radially inwardly curled lip is disclosed on the opposite inlet end of the tubular body. A delaminable laminated tubular body side wall is also disclosed along with a method of assembling such a disposable container.

33 Claims, 8 Drawing Figures

CARTRIDGE-TYPE DISPENSER

The present invention relates generally to improvements in containers. In one aspect the invention relates to improved container structure. In another aspect the invention relates to improved container construction technique.

Apparatus in use in one chain of fast service food outlets for dispensing one or more salad dressing-like food sauces comprises a trigger-actuated gun for discharging an accurately measured incremental quantity of such sauce on each single stroke of the gun trigger. The gun includes a reusable cylindrical container in which a piston works. A nozzle is attached to the container and comprises a fragile flat membrane of elastomeric material with crosshair cuts therein. The container, piston and nozzle of this apparatus must be disassembled and should be cleaned each time the container is emptied, and the container must then be refilled from a bulk supply. Economic as well as sanitary conditions make this procedure undesirable.

It has become quite customary in connection with devices generally referred to as caulking guns, put to their originally intended use, to supply caulking compound in disposable cartridges which remain sealed until placed in the gun. In some instances, the nozzle constitutes a permanent part of the gun and, accordingly, may have to be cleaned out after each use. In other instances, a nozzle comes with or is formed as a part of the disposable cartridge. In either event the nozzle usually is merely a tube having an inside diameter chosen to lay a bead of caulking compound having a predetermined diameter. Caulking compounds characteristically are heavy viscous materials which exhibit little, if any, tendency to exude from such nozzles in the absence of the considerable pressure which is exerted on the contents of the cartridge when extrusion of the compound is desired.

Mayonnaise, by definition, is a semisolid dressing made by emulsifying a mixture of raw eggs or egg yolks, vegetable oil and vinegar or lemon juice. With the addition of salt and condiments, it is used as a salad dressing or as a base for mixture with compatible materials to form salad dressings identified by various names. The consistency of mayonnaise, or mayonnaise-based salad dressings or dressings or sauces made in imitation thereof, is light and such products will extrude through a small orifice at very high velocity under very moderate pressure. Accordingly, when it is desired to extrude such material by means such as a caulking gun-type apparatus, a nozzle having an orifice of large effective diameter is required if excessive extrusion velocity is to be avoided. However, an orifice of appropriately large fixed cross-sectional area is impractical since the material usually will flow through such an orifice by gravity alone or by inertial forces incident to handling. It is for this reason that a flattened tube of elastomeric material has been used in the past to provide a nozzle which will expand and afford a large orifice only under discharge pressure.

In U.S. Pat. No. 3,884,396, a cartridge-type dispenser with resilient slitted outlet valve is disclosed for use with a caulking gun-type dispensing mechanism for the dispensing of sauces or the like of mayonnaise-like consistency. The cartridge-type dispenser disclosed in this patent comprises a cylindrical paperboard tube having a molded plastic dispensing head secured to the outlet end portion thereof by means of heat shrinkable tape. The dispensing head is provided with a male node which carries a frustoconically shaped nozzle therein, all of which is molded of a unitary mass of plastic material. The cartridge further includes a molded plastic plug closing the opposite end of the tubular body, which plug is secured to the tubular body by means of heat shrinkable tape until immediately prior to insertion of the cartridge-type dispenser into the dispenser gun. The outlet of the male node is also closed by means of a suitable seal until it is desired to dispense the contents thereof by means of the dispensing gun.

The construction of the cartridge-type dispenser of U.S. Pat. No. 3,884,396 is relatively expensive owing to the use of two molded plastic elements each requiring special mold tooling for the manufacture thereof and the excessively large number of manufacturing operations required to assemble, fill and seal the dispenser. The use of mold tooling for the manufacture of the dispensing head, designated by the reference character 20, also reduces the flexibility of the cartridge-type dispenser design of this patent to accommodate sauces or dressings of various consistency without complete redesign of the mold tooling.

In a variation of the design of the cartridge-type dispenser of U.S. Pat. No. 3,884,396, the molded plastic dispensing head has been modified to exclude the integral nozzle structure from the male node and accommodate in its place a removable nozzle insert constructed of a disc of flat plastic material having a plurality of mutually intersecting slits formed in the center thereof. This variation, however, adds an additional element to the dispenser structure and requires the additional manufacturing step of stamping or otherwise forming the nozzle insert from plastic sheet material as well as the additional assembly step of inserting each nozzle insert into the molded plastic dispensing head.

In U.S. Pat. No. 3,273,760, a cartridge-like container with expelling means for food products is disclosed wherein a flattened pliable dispensing nipple is provided for extruding the contents directly into the mouth of the consumer. This patent also shows, in certain modifications thereof, an extruding plunger which roughly nests with the head to minimize the amount of food product remaining in the package after a full stroke of the plunger. The dispensing nipple is not formed as an integral part of the cartridge and must be applied by the user after the cartridge has been opened.

U.S. Pat. No. 2,661,126 discloses a plunger-actuated dispensing container for viscous fluids such as printing ink. The orifice is relatively large but fixed in area whereby a removable closure must be removed and replaced incident to each use.

U.S. Pat. No. 3,682,356 discloses a mechanism for dispensing a fluid or pasty mass substance, including a piston device slidably mounted within a container which holds the substance. The container has a dispensing valve which is self-closing and which automatically opens when sufficient pressure is exerted upon the substance. The valve has an elastic conical element having a razor-like incision near the apex of the cone. When sufficient pressure is exerted on the substance, the incision opens to form a narrow slit through which the substance is dispensed. This patent does not, however, disclose a disposable cartridge-type dispensing package which performs the dual function of containing a food product from the time or packaging at a food processor's plant to the time of dispensing of the food product for ultimate consumption. Furthermore, the container structure disclosed in this patent is not adapted for use with a trigger-operated dispensing gun.

U.S. Pat. No. 3,029,987 discloses a spout with a frangible diaphragm for use with a caulking cartridge. Various forms of frangible disclosed in this patent are each formed of molded plastic requiring special mold tooling for each individual design with the attending expanse and flexibility limitations ordinarily associated with the use of such tooling. U.S. Pat. Nos. 2,102,939; 2,111,582; 2,478,078; 3,130,872; 3,161,325; 3,288,333 and 3,319,841 are illustrative of cartridge-type caulking guns with nozzles of various types including some which are formed as a part of the gun and others which are formed as a part of the cartridge.

The prior art also includes many well known forms of cake or candy decorating devices which include nozzles for extruding paste material to form rosettes, gadroon edging and the like. A widely used nozzle for this purpose has a star-shaped orifice somewhat resembling the orifice disclosed in U.S. Pat. No. 3,884,396. However, such star-shaped nozzles are, so far as is known, made of rigid material wherein the size and shape of the orifices remain unchanged under varying amounts of extruding pressure since the purpose of the nozzle is to form an extrusion having a definite cross-sectional shape.

The present invention contemplates a cartrdige-type dispenser or container of the type which includes a tubular body having first and second end portions with dispensing outlet means in the first end portion thereof and with the second end portion thereof being open. The dispenser is provided with plug closure means adapted to be disposed within the second end portion of the tubular body for closing the dispenser, the plug closure means having a closure side wall sized and shaped to be closely received within the second end portion of the tubular body and having radially outwardly extending closure lip means on the first end portion of the closure side wall adapted for yieldably engaging the inner surface of the tubular body. The closure side wall further includes at least one radially outwardly extending circumferential rib means on a first outer surface of the closure side wall adapted to tightly and slidingly engage the inner surface of the tubular body. The first outer surface of the closure side wall is generally frustoconically shaped and communicates with and tapers radially inwardly away from said closure lip means toward means closing a second end of the closure side wall.

The present invention further contemplates a method of assembling a cartridge-type dispenser or container of the type which includes a generally cylindrical tubular body having first and second end portions with dispensing outlet means in the first end portion thereof and with the second end portion thereof being open. The method includes disposing plug closure means within the second end portion of the tubular body to thereby close the cartridge-type dispenser, with the plug closure means having a closure side wall sized and shaped to be closely received within the second end portion of the tubular body and having radially outwardly extending closure lip means on a first end portion of the closure side wall yieldably engaging the inner surface of the tubular body. The method also includes sealing the plug closure means to the inner surface of the tubular body to provide a liquid-tight annular seal therebetween.

An object of the invention is to reduce the cost of cartridge-type fluid dispensers.

Another object of the invention is to provide a cartridge-type dispenser of simplified construction.

A further object of the invention is to icnrease the strength of cartridge-type fluid dispensers.

A still further object of the invention is to provide a cartridge-type dispenser which can be economically disposed of after a single use.

Yet another object of the invention is to provide a cartridge-type dispenser which is exceptionally clean during the performance of dispensing operations.

Another object of the invention is to provide a cartridge-type dispenser which is flat on both ends and reduces storage and shipping space required.

Still another object of the invention is to provide a cartridge-type dispenser which is economical to produce and is simple and reliable in operation.

Other objects and advantages of the invention will be apparent from the following detailed description and claims when read in conjunction with the accompanying drawings in which:

Figure 1:
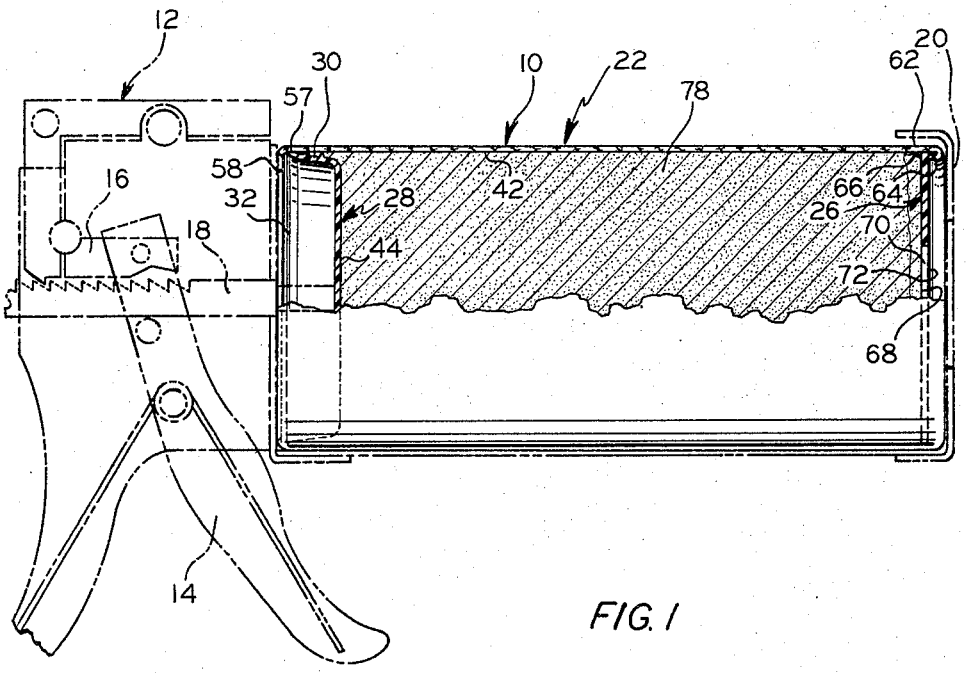
FIG. 1 is a side elevation view of a cartridge-type dispenser constructed in accordance with the present invention, with portions thereof shown in cross section, showing the cartridge-type dispenser filled with a dispensable product and positioned for use in a dispensing gun, the dispensing gun being illustrated in phantom lines.

Referring now to the drawings, and FIG. 1 in particular, a disposable cartridge-type dispensing package 10, constructed in accordance with the present invention, is shown positioned in a dispensing gun 12, illustrated in phantom broken lines, the cartridge being filled and ready for immediate use. The gun 12 is preferably of the type which dispenses an accurately measured increment of the contents of the package or cartridge 10 upon each actuation thereof. To this end, the gun 12 can be provided with a trigger 14 and pawl and detent or other escapement means diagrammatically indicated at 16 adapted to cooperate with teeth on the piston rod of a plunger or follower generally indicated at 18, all as is well known in the art. A wall 20 is provided at the forward end of the gun 12 against which the forward end of the cartridge 10 rests so that pressure applied by the trigger mechanism of the gun 12 can be effective to dispense the contents of the cartridge as will be explained hereinafter.

The cartridge 10 comprises a generally cylindrically shaped tubular body or side wall 22 preferably constructed of a normally solid thermoplastic-coated, foil-laminated, food-grade paperboard. While any type of material can be employed in the construction of the tubular side wall 22 which will provide the desired physical strength and food handling characteristics, it is presently preferred to employ a polyethylene-coated, foil-laminated, food-grade paperboard having a thickness of about 0.17 inch (4.32 mm) and having a conventional overlapped side seam 24, which seam is formed by applying sufficient heat and pressure to the overlapped portions of the side wall to cause autogenous bonding of the superposed polyethylene-coated surfaces thereof. One such suitable paperboard is available from International Paper Company and is designated as 17 point solid bleached Kraft, foil laminted, polyethylene coated on both sides. The cartridge-type dispensing package or container 10 also comprises a dispensing head 26 and an extruding plug top closure or piston 28 designed to cooperate with the plunger or follower 18 of the dispensing gun 12.

The plug top closure 28 can be made of any suitable material, however, the closure 28 is preferably formed of a unitary homogeneous mass of plastic material such as a synthetic resin material. Examples of suitable synthetic resin material for use in constructing the plug top closure 28 include normally solid thermoplastic materials comprising at least one alpha olefin polymer. Examples of suitable alpha olefin polymers include high density polyethylene, low density polyethylene and polypropylene, with high density polyethylene being presently preferred.

The plug top closure 28 comprises a closure side wall 30 sized and shaped to be closely received within the generally cylindrical tubular side wall 22. A radially outwardly extending closure lip 32 is formed on the first end portion 34 of the side wall 30 of the plug top closure 28 and is adapted to yieldably engage the inner surface of the tubular side wall 22. A pair of longitudinally spaced, radially outwardly extending circumferential ribs 36 and 38 are formed on a first generally frustoconically shaped outer surface 40 of the closure side wall 30 and are sized and shaped to tightly, frictionally engage the inner surface 42 of the tubular side wall 22 to provide means for both frictionally retaining the plug top closure 28 within the tubular side wall with the closure lip 32 yieldably engaging the inner surface 42 and wiping the inner surface 42 clean of the contents of the container 10 during the sliding operation of the plug top closure 28 relative to the tubular side wall 22 in cooperation with the plunger 18 of the dispensing gun 12. The ribs 36 and 38 preferably each terminate at their radially outermost portion in a generally circumferential knife edge having an included angle of approximately 48 degrees.

The plug top closure 28 further includes a generally radial end wall 44 closing the plug top closure at the second end portion 46 thereof opposite the closure lip 32. The generally radial end wall 44 communicates with the outer surface 40 of the closure side wall 30 by means of a generally frustoconically shaped or tapered transition portion 48. The apical angle of the outer surface of the generally frustoconically shaped transition portion 48 is preferably approximately 40 degrees, and the apical edge of the general frustoconically shaped outer surface 40 is preferably approximately 12 degrees. The frustoconically shaped or tapered transition portion 48 facilitates the insertion of the plug top closure 28 into the respective open end of the tubular side wall 22 subsequent to the filling of the container 10 with the material to be dispensed therefrom. In this regard, the annular rib 38 is preferably interrupted at four circumferentially spaced locations 50 to provide means for venting air past the rib 38 during high speed insertion of plug top closures 28 into tubular side walls 22 by automatic packaging machinery.

Figure 2:
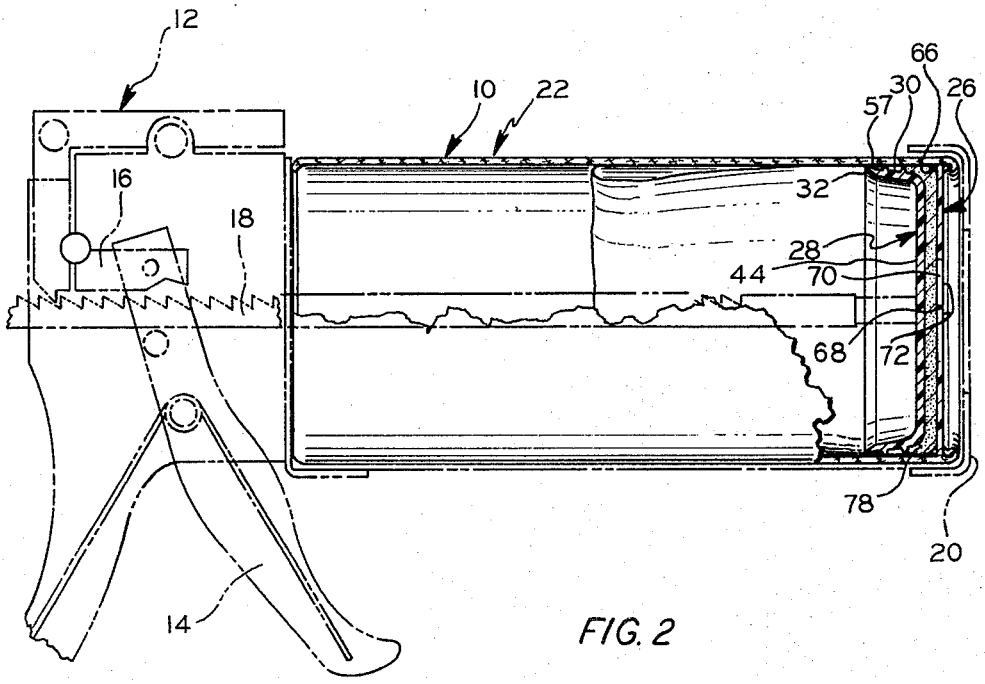
FIG. 2 is a side elevation view similar to FIG. 1 illustrating the cartridge-type dispenser in a condition assumed after a substantial portion of the dispensable product has been dispensed therefrom.
Figure 3:
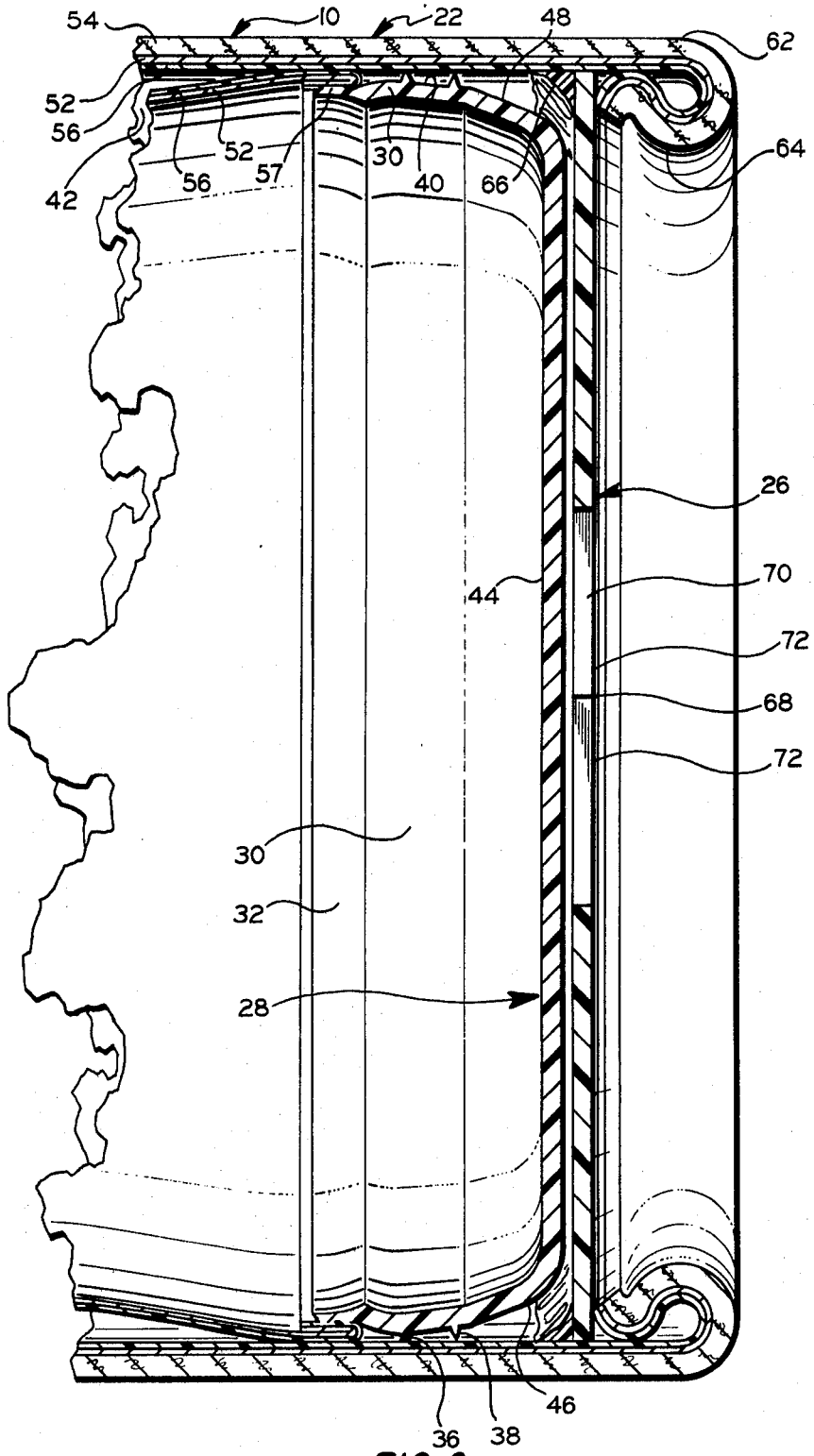
FIG. 3 is a partial enlarged side elevation view similar to FIG. 2 illustrating the cartridge in a condition assumed after substantially all the dispensable product has been dispensed therefrom.
Figure 4:
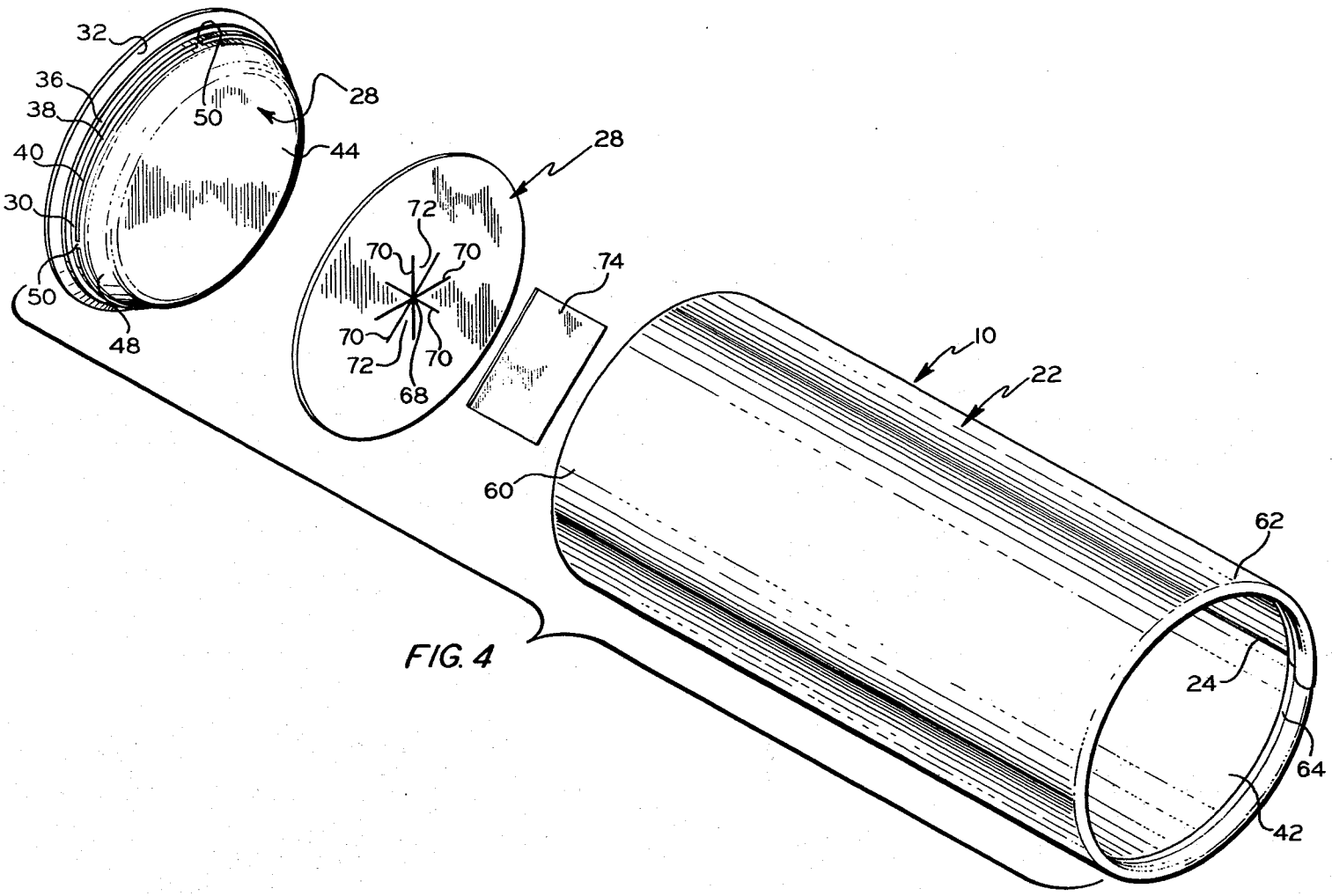
FIG. 4 is an exploded isometric view of an empty cartridge-type dispenser in accordance with the present invention.
Figure 8:
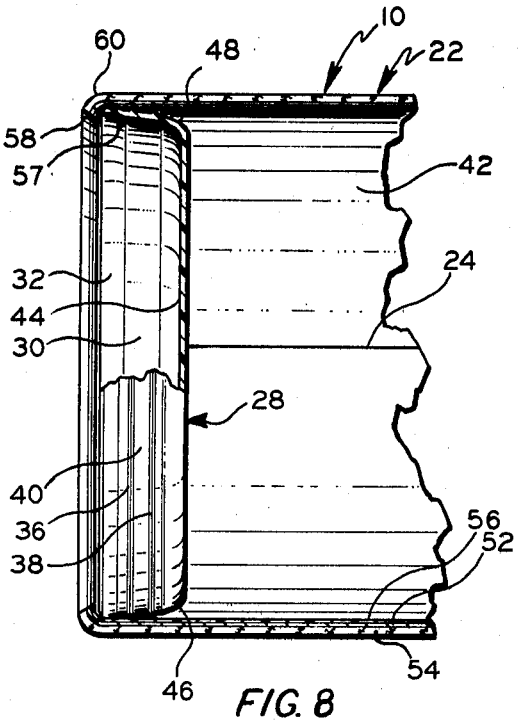
FIG. 8 is a partial side elevation view of the plug top end portion of the cartridge-type dispenser with portions thereof shown in cross section.

As best shown in FIGS. 1, 3 and 8, the plug top closure 28, when properly installed within the tubular side wall 22, is secured to the inner surface 42 of the tubular side wall 22 to achieve an annular fluid or liquid tight seal therebetween. This seal is preferably achieved between the closure lip 32 and the inner surface 42. As mentioned above, the tubular side wall 22 preferably includes a thin metal foil laminate 52 suitably adhered to the inner surface of an outer laminate 54 of food-grade paperboard. A thin coating of normally solid thermoplastic material, preferably polyethylene, is adhered to the inner surface of the metal foil laminate 52 and is designated by the reference character 56. The annular seal between the closure lip 32 and the metal foil laminate 52 is preferably achieved by mutually fusing the outer surface of the closure lip 32 and the polyethylene film laminate 56 as shown at 57. The strength of this annular seal has been found to exceed the strength of the bond between the metal foil laminate 52 and the paperboard outer laminate 54 when the plug top closure 28 is moved through the tubular side wall 22 under the influence of the plunger 18 of the dispensing gun 12. The resulting delaminating action between the metal foil laminate 52 and the outer paperboard laminate 54 is depicted in FIGS. 2 and 3. It will be seen that as the plug top closure 28 traverses the inner surface 42 of the tubular side wall 22, the delaminated metal foil polyethylene coated laminate 52 is drawn therebehind, thus preventing the release of any of the material being dispensed thereby behind the plug top closure 28.

The tubular side wall 22 is preferably provided with a radially inwardly curled lip 58 formed on the inlet end portion 60 thereof. The inwardly curled lip 58 provides additional means for assuring the integrity of the package 10 after it has been filled with dispensable material and closed and sealed by means of the plug top closure 28 in the manner described above.

The dispensing head 26 preferably formed of a one-piece, generally flat circular disc disposed within the tubular side wall 22 at the outlet end portion 62 thereof. The dispensing head 26 has a diameter slightly less than the inside diameter of the inner surface 42 of the tubular side wall 22 so as to be closely received therein, and is positioned in abutting relation to a radially inwardly rolled lip 64 formed on the outlet end portion 62 of the tubular side wall 22. The dispensing head 26 is fixedly secured in abutting relation with the lip 64 by means of a continuous circumferential bead or fillet of suitable adhesive communicating between the periphery of the dispensing head 26 and the inner surface 42 of the tubular side wall 22 as shown at 66. The continuous circumferential fillet of adhesive 66 provides a fluid-tight seal between the dispensing head 26 and the tubular side wall 22.

The dispensing head 26 can be formed of any suitable sheet material which will provide the desired closure of the outlet end portion 62 of the tubular side wall 22. While any sheet material suitable for this purpose can be employed, it is presently preferred to utilize a sheet of synthetic resinous material. Examples of such suitable synthetic resinous material include normally solid thermoplastic materials such as those comprising at least one alpha olefin polymer, including high density polyethylene and low density polyethylene, with low density polyethylene being presently preferred. Suitable materials for the construction of the dispensing head 26 are characterized by inherent resiliency.

The dispensing head 26 is provided with a generally star-shaped orifice 68 located in the central portion thereof. The orifice is composed of a plurality of slits 70 which mutually converge at the center of the dispensing head 26. The orifice 68 preferably comprises eight equally angularly spaced slits 70 which define a plurality of separate petal-like fingers or blades 72 which taper in width from the base of each blade to terminate in narrow pointed tips at the central point of the orifice 68. In a preferred embodiment, the thickness of the low density polyethylene sheet material forming the dispensing head 26 is approximately 0.030 inch (0.76 mm) and each slit is approximately 0.5 inch (1.27 cm) in length from the base of the adjacent plate 72 to the center of the orifice 68. The width of each slit 70 is preferably substantially zero when the fingers or blades 72 defining the orifice 68 are in their relaxed or closed position.

Figure 5:
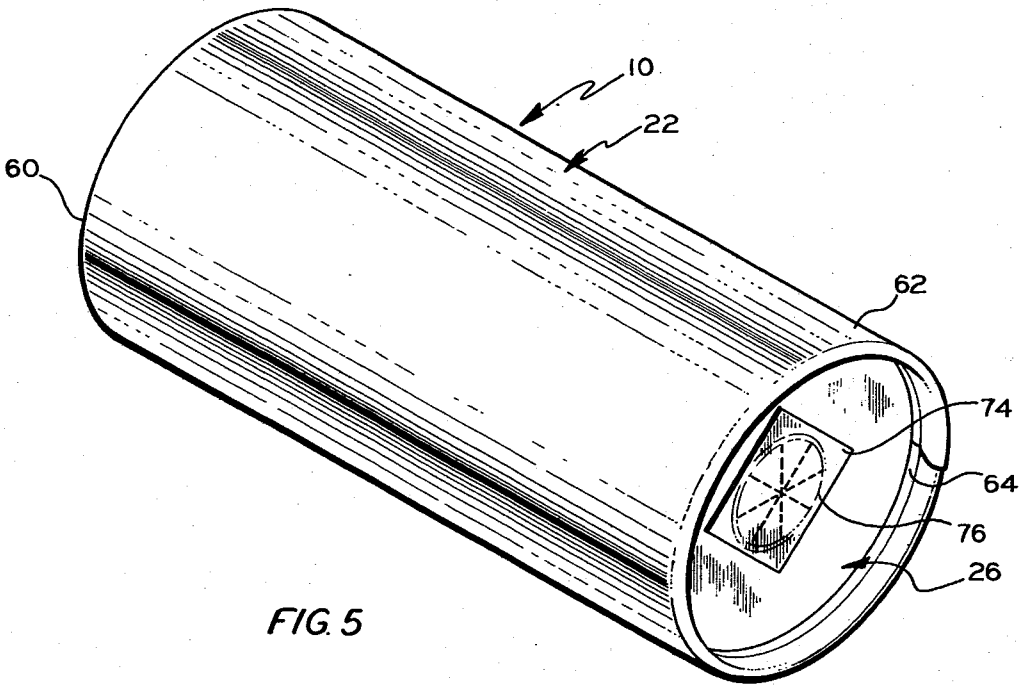
FIG. 5 is an isometric view of the cartridge-type dispenser of FIG. 4 fully assembled and closed.
Figure 6:
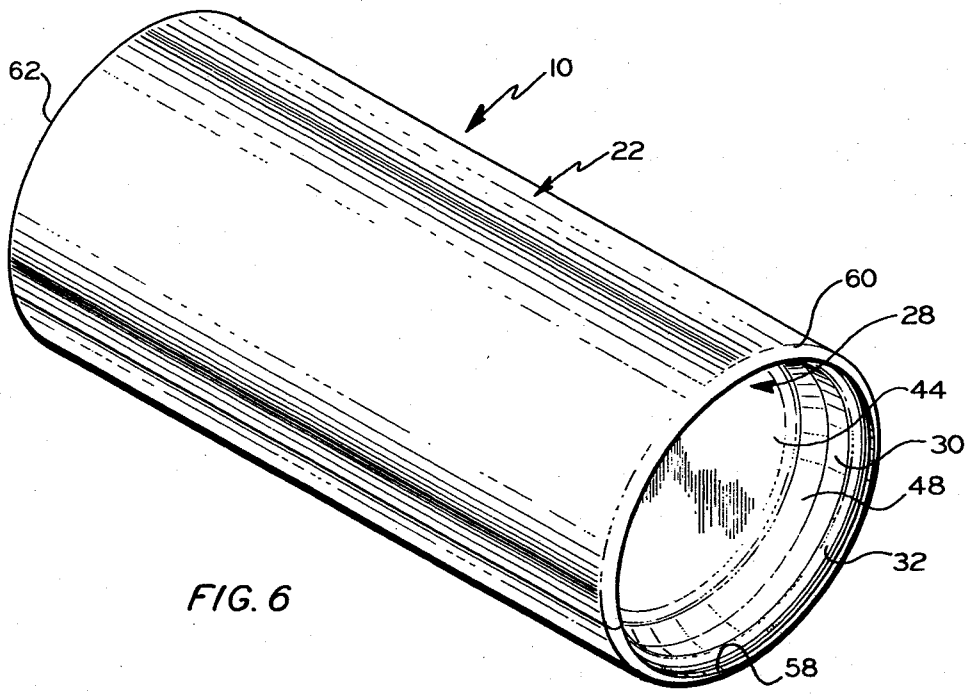
FIG. 6 is an isometric view of the opposite end of the cartridge-type dispenser of FIG. 5 illustrating the cartridge-type dispenser fully assembled and closed.
Figure 7:
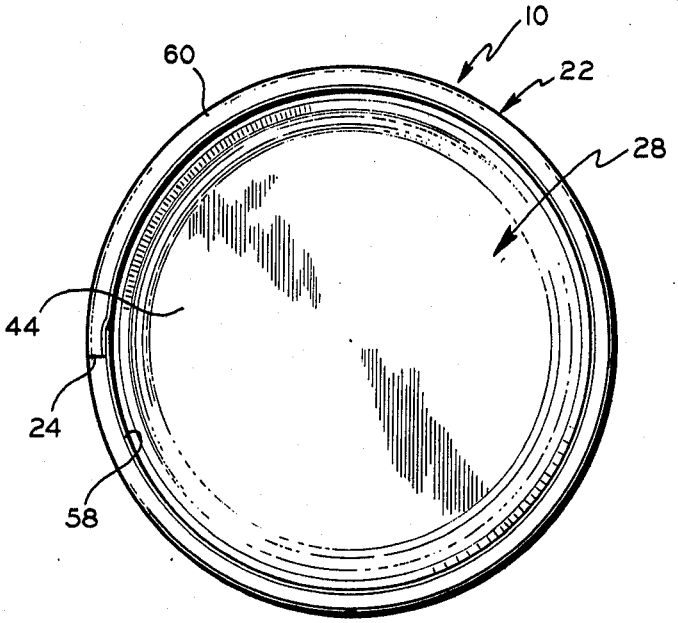
FIG. 7 is an end elevation view of the plug top end portion of the cartridge-type dispenser.

The orifice 68 of the dispensing head 26 is provided with a removable seal 74 which is adapted to be applied over the orifice 68 to prevent the passage of the contents of the container 10 through the orifice 68 until it is desired to begin dispensing the contents thereof through the action of the dispensing gun 12. The seal 74 can be of any suitable shape capable of covering the orifice 68 and is preferably provided with means thereof which can serve as a pull tab to facilitate the removal of the seal from the dispensing head 26. Preferably, the seal 74 is of a rectangular or square shape, whereby any one of the four corners can serve as a pull tab. The seal 74 can be made of plastic tape with adhesive applied to one surface thereof or, more preferably, a metal foil, such as aluminum, coated on one surface with a pressure- or heat-sensitive adhesive. In either case the adhesive-coated side of the seal 74 is pressed against the outer surface of the dispensing head 26 and is secured thereto by application of pressure or of heat and pressure as required. It is presently preferred to utilize the previously mentioned metal foil with a heat-sensitive adhesive on one surface thereof which is secured to the dispensing head 26 by means of heat and pressure applied to the seal 74 in the form of a heated ring of a diameter substantially greater than the diameter of the orifice 68, as shown at 76 in FIG. 5.

It is presently preferred to construct the plug top closure or piston 28 of molded high density polyethylene, as mentioned above, with the plug top closure having a nominal wall thickness of about 0.040 inch (1.02 mm). The closure lip 32 preferably extends radially outwardly and longitudinally away from the first end portion 34 of the plug top closure 28 at an angle of approximately 45 degrees from the longitudinal axis of the plug top closure. The thickness of the closure lip 32 is preferably approximately 0.010 inch (0.25 mm), which thickness provides a suitable amount of resiliency to the closure lip 32 to maintain intimate contact between the closure lip and the inner surface 42 of the tubular side wall 22 and to provide sufficient thermoplastic material to achieve the previously described annular seal 57 therebetween. These preferred dimensions, and the other preferred dimensions relating to the dispensing head 26 provide a cartridge-type dispensing package or container 10 which is well adapted for the dispensing of a dispensable product having the consistency of mayonnaise, catsup or other similar products. On each stroke of the trigger 14, the dispensing head 26 will automatically assure that the desired quantity of such dispensable contents 78, as shown in FIGS. 1 and 2, will be dispensed at a low velocity irrespective of the manner in which the trigger 14 may be activated due to the resilient valve action of the fingers or blades 72 defined in the orifice 68 in the dispensing head. Preferably each actuation of the trigger 14 is effective to extrude an accurately predetermined quantity of the dispensable contents of the container 10. For example, the trigger mechanism can be designed to extrude substantially exactly one-third of a fluid ounce of the dispensable contents of each stroke of the trigger. When the contents 78 have been substantially completely dispensed, the parts of the package assume the position shown in FIG. 3 wherein the plug top closure or piston 28 has moved into abutment with the inner surface of the dispensing head 26, and further movement of the plug top closure is prevented.

It should be noted at this point that upon the initial advancement of the plug top closure 28 through the tubular side wall 22 from the position illustrated in FIG. 1, the metal foil laminate 52 and polyethylene film laminate 56 which are sealed to the plug top closure 28 are delaminated from the outer paperboard laminate 54, and further movement of the plug top closure 28 through the tubular side wall 22 causes the thus delaminated laminates 52 and 56 to be stripped from the outer laminate 54 thus maintaining isolation of the contents 78 within the package 10.

The cartridge-type dispensing package or container 10 is well adapted for manufacture on the container manufacturing apparatus disclosed in U.S. Pat. No. 4,072,226, issued Feb. 7, 1978, and assigned to the assignee of record of the instant application.

Assembly of the container 10 can be achieved in the following manner. Each dispensing head 26, with a seal 74 secured thereto closing the orifice 68, is positioned by a suitable bottom feeder mechanism on the outer end of a respective mandrel which dispensing head is retained on the mandrel by means of vacuum applied to the mandrel. The dispensing head is positioned in the mandrel with the seal on the side of the dispensing head remote from the mandrel. The mandrel securing the respective dispensing head is then moved or indexed to a position adjacent a suitable side wall feeder at which point a respective flat generally rectangular side wall blank, having first and second parallel side edge portions and first and second end faces, is first heated along its first and second parallel side edge portions which will ultimately be overlapped, and is then positiond adjacent to and clamped on the cylindrical outer surface of the mandrel carrying the dispensing head. The mandrel carrying the dispensing head and side wall blank is then moved or indexed to a position adjacent a suitable side wall wrapper mechanism at which time the side wall blank is wrapped about the cylindrical outer surface of the mandrel and the previously heated parallel side edge portions are overlapped and clamped together and allowed to cool, thereby forming the overlapped side seam 24 when the superposed heated thermoplastic coated layers become autogenously bonded together to form the tubular body or side wall 22.

The mandrel carrying the thus formed tubular side wall 22 and dispensing head 26 is then moved or indexed to a position adjacent a suitable bond heater where the thermoplastic coating of the tubular side wall at the end thereof adjacent the dispensing head can be optionally heated to a suitable bonding temperature of the thermoplastic coating. If desired, this heating step can be omitted although the mandrel will still be indexed to and from this position in the operation of the conventional container manufacturing apparatus described in U.S. Pat. No. 4,072,226. The mandrel carrying the tubular side wall and dispensing head is then moved or indexed to a position adjacent a rotating bottom sealing head which moves in coaxial alignment with the tubular side wall into engagement with the either heated or unheated continuous edge of the tubular side wall adjacent the dispensing head, and rolls the continuous edge inwardly, thereby forming a radially inwardly rolled lip 64 which abuttingly engages the outer periphery of the respective dispensing head.

After formation of the rolled lip 64, the rotating bottom sealing head is then withdrawn from the thus formed roll lip and the mandrel carrying the partially assembled container comprising a tubular side wall 22 and dispensing head 26 secured thereto is moved or indexed to a doffing position where the partially assembled container is removed by suitable means from the mandrel and conveyed away by suitable conveyor means to a finishing station. At the finishing station, the partially assembled container is grasped at the end thereof adjacent the dispensing head 26 by a suitable rotating head and is rotated thereby about the longitudinal axis of the tubular side wall 22 during which rotation a quantity of a suitable adhesive is directed by means of suitable nozzle means onto the continuous juncture within the tubular side wall 22 between the inner surface 42 thereof and the outer periphery of the dispensing head 26 to thereby form the continuous bead or fillet of adhesive 66 between the dispensing head and the tubular side wall to provide a fluid-tight seal therebetween. A suitable adhesive for the formation of the continuous bead or fillet 66 is a hot melt lutting designated as Finley No. 295-337.

The thus partially assembled container is ready to be filled with the dispensable contents 78 by any suitable filling means, either manual or automatic. After the partially assembled container is filled with the dispensable contents 78, the plug top closure 28 is inserted into the open end portion of the tubular side wall 22 until the closure lip 32 yieldably engages the inner surface 42 of the tubular side wall adjacent the open end portion of the tubular side wall. The plug top closure 28 is then sealed to the inner surface 42 preferably by fusing at least a portion of the closure lip 32 to the inner surface 42 as shown at 57. This is preferably achieved by means of a suitable bond heater whereby the thermoplastic film laminate 56 and the portion of the closure lip 32 in contact therewith are heated to a suitable bonding temperature of the two thermoplastic materials. The open upper end portion of the tubular side wall 22 is subsequently inwardly curled as shown at 58 by suitable means such as a crimping head or rotating curling head coaxially aligned with the longitudinal axis of the tubular side wall 22.

The cartridge-type dispensing package or container 10, as described above, has been designed to minimize costs associated with materials and assembly and with sufficient ruggedness to survive filling, closing, packing and shipping in suitable groups in shipping containers which are delivered to a food outlet where the cartridge-type dispensing packages are removed from the shipping containers as needed for reloading the previously described dispensing guns. More rugged and more expensive construction can be utilized to adapt the instant cartridge-type dispensing containers for additional demands which could be placed upon them if they were to be distributed for individual handling and retail sale to private customers or individual restaurants. For example, the plug top closure 28 could be even more securely retained within the tubular side wall 22 during shipping and handling by passing a length of tape from one side of the tubular side wall transversely across the plug top closure 28 to the opposite side of the tubular side wall. Such tape couuld be in the form of an elongated strip of paper or plastic sheet material having suitable adhesive on one side thereof adapted to securely engage the outer surface of the tubular side wall. It will be understood that such tape would be removed from the container 10 prior to the positioning thereof within the dispensing gun 12.

Changes may be made in the combination and arrangement of parts or elements as heretofore set forth in the specification and shown in the drawings without departing from the spirit and scope of the invention as defined and limited only by the following claims.

That which is claimed is:

1. A container comprising:

a generally cylindrically shaped tubular side wall formed of a delaminable laminated sheet material and having an inner surface and first and second open end portions, the first open end portion terminating in a radially inwardly rolled lip;

a generally flat circular disc disposed within said tubular side wall in abutting relation with the radially inwardly rolled lip, said circular disc having a plurality of slits therethrough and mutually intersecting at a point positioned generally in the center of said circulating disc;

means disposed about the periphery of said circular disc and communicating between said circular disc and said tubular side wall for securing said circular disc within said tubular side wall in abutting relation with said inwardly rolled lip and providing a substantially liquid tight seal between said circular disc and said tubular side wall; and plug top closure means disposed within said tubular side wall adjacent the second open end portion thereof, said plug top closure means having a closure side wall sized and shaped to be closely received within the second open end portion of said tubular side wall, said closure side wall having radially outwardly extending closure lip means on a first end portion thereof adapted for yieldably engaging the inner surface of said tubular sidewall and formed of a normally solid thermoplastic material fusion sealed to the inner surface of said tubular side wall, and said plug top closure means further including generally radial end wall means extending across and closing a second end portion of said closure side wall.

2. A container in accordance with claim 1 wherein said tubular side wall is characterized further to include:

radially inwardly rolled lip means on the second open end portion for retaining said plug top closure means within said tubular side wall.

3. A container in accordance with claim 1 wherein said delaminable laminated sheet material comprises an outer laminate of paperboard and an inner laminate of metal foil, said inner laminate being delaminable from said outer laminate upon the application of a predetermined amount of delaminating force applied to one of said laminates relative to the other of said laminates.

4. A container in accordance with claim 3 wherein said thermoplastic material of said lip means is fusion sealed to said inner laminate of metal foil.

5. A container in accordance with claim 3 wherein said inner laminate of metal foil is further coated with a film of normally solid thermoplastic material adhered to said metal foil.

6. A container in accordance with claim 5 wherein said thermoplastic material of said lip means is fusion sealed to said thermoplastic film adhered to said metal foil.

7. A container in accordance with claim 1 wherein the outer surface of said closure side wall of said plug top closure means is generally frustoconically shaped, tapering inwardly from said first end portion toward said second end portion.

8. A container in accordance with claim 7 wherein said closure side wall further includes at least one radially outwardly extending circumferentially rib means on the generally frustoconically shaped outer surface thereof, said rib means being sized and shaped to tightly and slidingly engage the inner surface of said tubular side wall.

9. A container in accordance with claim 7 wherein said plug top closure means is characterized further to include two radially outwardly extending circumferential rib means in longitudinally spaced relation on said generally frustoconically shaped outer surface of said closure side wall.

10. A container in accordance with claim 9 wherein the radially outwardly extending circumferential rib means nearest the second end portion of said generally frustoconically shaped outer surface of said closure side wall is interrupted at at least one location so as to provide means for venting air therepast during insertion of said plug top closure means in the second end portion of said tubular side wall.

11. A container in accordance with claim 1 wherein said closure side wall of said plug top closure means comprises a first generally frustoconically shaped portion tapering radially inwardly from said closure lip means toward said first end portion of said plug top closure means at a first angle and a second generally frustoconically shaped transition portion communicating with said first generally frustoconically shaped portion and tapering radially inwardly at a second angle from said first generally frustoconically shaped portion toward said generally radial end wall means.

12. A container in accordance with claim 11 wherein said plug top closure means is characterized further to include at least one radially outwardly extending circumferential rib means on the outer surface of the first generally frustoconically shaped portion thereof, said rib means being sized and shaped tightly and slidingly engage the inner surface of said tubular side wall.

13. A container in accordance with claim 11 wherein said plug top closure means is characterized further to include two radially outwardly extending circumferential rib means in longitudinal spaced relation to the outer surface of the first generally frustoconically shaped portion of said plug top closure means.

14. A container in accordance with claim 13 wherein the radially outwardly extending circumferential rib means nearest said second generally frustoconically shaped transition portion is interrupted at at least one location so as to provide means for venting air therepast during insertion of said plug top closure means in the second end portion of said tubular side wall.

15. A container in accordance with claim 14 wherein said plug top closure means is formed of a unitary homogeneous mass of normally solid thermoplastic material.

16. In a cartridge-type dispenser of the type which includes a generally cylindrical tubular body having first and second end portions with dispensing outlet means in the first end portion thereof and with the second end portion thereof being open, the improvement comprising:

a delaminable laminate defining an inner surface of said tubular body; and plug closure means adapted to be disposed within the second end portion of said tubular body for closing said cartridge-type dispenser, said plug closure means having a closure side wall sized and shaped to be closely received within the second end portion of said tubular body and having radially outwardly extending closure lip means on a first end portion of said closure side wall formed of a normally solid thermoplastic material fusion sealed to the inner surface of said tubular body, said closure side wall further including at least one radially outwardly extending circumferential rib means on a first outer surface of said closure side wall adapted to tightly and slidingly engage the inner surface of said tubular body, said first outer surface of said closure side wall being generally frustoconically shaped and communicating with and tapering radially inwardly away from said closure lip means toward means closing a second end of said closure side wall.

17. A cartridge-type dispenser in accordance with claim 16 wherein said plug closure means is characterized further to include two of said radially outwardly extending circumferential rib means in longitudinally spaced relation on said first outer surface of said closure side wall.

18. A cartridge-type dispenser in accordance with claim 17 wherein the radially outwardly extending circumferential rib means nearest the second end of said closure side wall is interrupted at at least one location so as to provide means for venting air therepast during insertion of said plug closure means in the second end portion of said tubular body.

19. A cartridge-type dispenser in accordance with claim 18 wherein said means closing a second end of said closure side wall is characterized further to include a generally radial end wall and a generally frustoconically shaped radially inwardly tapered transition portion communicating between said first outer surface of said closure side wall and said generally radial end wall, said tapered transition portion being radially inwardly tapered at an angle greater than the angle of radially inward taper of said first outer surface for facilitating the insertion of said plug closure means in the second end portion of said tubular body.

20. A cartridge-type dispenser in accordance with claim 1 wherein said means closing a second end portion of said closure side wall is characterized further to include a generally radial end wall and a generally frustoconically shaped radially inwardly tapered transition portion communicating between said first outer surface of said closure side wall and said generally radial end wall, said tapered transition portion being radially inwardly tapered at an angle greater than the angle of radially inward taper of said first outer surface for facilitating the insertion of said plug closure means in the second end portion of said tubular body.

21. A cartridge-type dispenser in accordance with claim 16 wherein said tubular body is characterized further to include:

radially inwardly curled lip means on the second end portion of said tubular body for retaining said plug closure means within said tubular body.

22. A cartridge-type dispenser in accordance with claim 16 wherein said delaminable laminate comprises a sheet of metal foil, and wherein said metal foil is delaminable from an outer laminate upon the application of a predetermined amount of delaminating force between said metal foil and said outer foil.

23. A cartridge-type dispenser in accordance with claim 22 wherein said thermoplastic material of said closure lip means is fusion sealed to said metal foil.

24. A cartridge-type dispenser in accordance with claim 22 wherein said metal foil is further coated on the inner surface thereof with a film of normally solid thermoplastic material adhered to said metal foil.

25. A cartridge-type dispenser in accordance with claim 24 wherein said thermoplastic material of said closure lip means is fused to said film of thermoplastic material.

26. A cartridge for holding and dispensing dispensable materials, said cartridge comprising:

a generally cylindrical tubular body having first and second end portions, said body being laminated and having an inner laminate adapted to delaminate;

outlet means in the first end portion of said tubular body for dispensing the contents thereof; and a plug closure disposed within the second end portion of said tubular body, said closure having an end wall extending across the second end portion of said body to close the same and a peripheral portion of said end wall bonded to said inner laminate, whereby the bond between said peripheral portion and inner laminate effects delamination of the inner laminate upon movement of said plug closure toward said outlet to dispense the contents of said tubular body.

27. A cartridge as set forth in claim 26, wherein:

said inner laminate has an inner surface coated with normally solid thermoplastic material;

said peripheral portion of the end wall is formed of a normally solid thermoplastic material; and said thermoplastic materials are fusion bonded to bond said peripheral portion to said inner laminate.

28. A cartridge as set forth in claim 26, wherein said peripheral portion of the end wall of said plug closure includes:

a side wall extending from said end wall, said side wall fitting closely within said tubular body; and a flexible lip extending outwardly from said end wall and yieldably contacting said tubular body, said lip being bonded to said inner laminate.

29. A cartridge as set forth in claim 28, wherein:

said inner laminate has an inner surface coated with a normally solid thermoplastic material;

said lip is formed of a normally solid thermoplastic material; and said thermoplastic materials are heat sealed together to bond said lip to said inner laminate.

30. A cartridge as set forth in claim 29, wherein said lip has a lesser thickness than said side wall.

31. A cartridge for holding and dispensing dispensable materials, said cartridge comprising:

a generally tubular body having opposite first and second ends and a hollow interior for holding dispensable materials;

a plurality of laminates forming said tubular body, including an inner laminate adapted to delaminate when subjected to a predetermined force;

a dispensing outlet in said first end of the body for dispensing the contents thereof;

a plug closure disposed within the second end of said body, said closure having a side wall fitting closely within said tubular body and an end wall extending across and closing a first end portion of said side wall; and an outwardly extending lip projecting from a second end portion of said side wall, said lip being heat sealed to said inner laminate of the body to effect delamination of said inner laminate upon movement of said plug closure toward the dispensing outlet under the influence of a force in excess of said predetermined force.

32. A cartridge as set forth in claim 31, wherein:

said inner laminate has an inner surface coated with a normally solid thermoplastic material;

said lip is formed of a normally solid thermoplastic material; and said thermoplastic materials of the inner laminate and lip are fused together.

33. A cartridge as set forth in claim 32, wherein said lip has a lesser thickness than said side wall.

* * * * *

UNITED STATES PATENT AND TRADEMARK OFFICE

CERTIFICATE OF CORRECTION

PATENT NO. : 4,432,473

DATED : Feb. 21, 1984

INVENTOR(S) : George E. MacEwen and Raymond C. Taylor

It is certified that error appears in the above-identified patent and that said Letters Patent are hereby corrected as shown below:

Please add the name of Raymond C. Taylor, Kansas City, Missouri as co-inventor in the above-identified patent.

Signed and Sealed this

*Nineteenth* Day of *June 1984*

[SEAL]

*Attest:*

GERALD J. MOSSINGHOFF

*Attesting Officer* *Commissioner of Patents and Trademarks*